US010040582B2

(12) United States Patent
Gai

(10) Patent No.: US 10,040,582 B2
(45) Date of Patent: Aug. 7, 2018

(54) FILLING DEVICES FOR ISOBARIC FILLING MACHINES FOR FILLING BOTTLES WITH ALIMENTARY LIQUIDS

(71) Applicant: GAI MACCHINE IMBOTTIGLIATRICI S.p.A., Ceresole d'Alba (Cuneo) (IT)

(72) Inventor: Carlo Gai, Ceresole d'Alba (IT)

(73) Assignee: GAI MACCHINE IMBOTTIGLIATRICI S.P.A., Ceresole d'Alba, Cuneo (IT)

( * ) Notice: Subject to any disclaimer, the term of this patent is extended or adjusted under 35 U.S.C. 154(b) by 0 days.

(21) Appl. No.: 14/433,383

(22) PCT Filed: Oct. 4, 2013

(86) PCT No.: PCT/IB2013/059118

§ 371 (c)(1),
(2) Date: Apr. 3, 2015

(87) PCT Pub. No.: WO2014/054027

PCT Pub. Date: Apr. 10, 2014

(65) Prior Publication Data

US 2015/0274332 A1 Oct. 1, 2015

(30) Foreign Application Priority Data

Oct. 5, 2012 (IT) ..... TO2012A0869
Apr. 15, 2013 (IT) ..... TO2013A0302

(51) Int. Cl.
*B65B 3/10* (2006.01)
*B67C 3/26* (2006.01)

(52) U.S. Cl.
CPC ..... *B65B 3/10* (2013.01); *B67C 3/262* (2013.01); *B67C 2003/2651* (2013.01); *B67C 2003/2668* (2013.01)

(58) Field of Classification Search
CPC ..... B67C 3/262; B67C 3/2617; B67C 2003/2668; B67C 2003/2651
USPC ..... 141/57
See application file for complete search history.

(56) References Cited

U.S. PATENT DOCUMENTS 3,834,428 A * 9/1974 Rademacher ..... B67C 3/2628 141/39
3,908,717 A * 9/1975 Rademacher ..... B67C 3/06 141/392
4,102,365 A 7/1978 Jordan et al.
5,080,147 A 1/1992 Millet et al.
5,372,167 A 12/1994 Hirose et al.
5,474,113 A * 12/1995 Rademacher ..... B67C 3/2608 141/116

(Continued)

FOREIGN PATENT DOCUMENTS

EP 1995208 A1 11/2008
EP 2236454 A1 10/2010

(Continued)

*Primary Examiner* — Timothy L Maust
*Assistant Examiner* — Andrew Schmid
(74) *Attorney, Agent, or Firm* — Robert E. Alderson, Jr.

(57) ABSTRACT

Filling devices for isobaric filling machines for filling bottles with alimentary liquids such as beer or wine are provided. Such devices provide a high degree of precision with respect to the filling level of the bottle, are constructionally and functionally simple and are easy to wash and sterilize. Isobaric filling machines which include one or more such devices are also provided.

12 Claims, 5 Drawing Sheets

(56) References Cited

U.S. PATENT DOCUMENTS 5,564,481 A * 10/1996 Clusserath ..... B67C 3/10 141/39
5,634,500 A * 6/1997 Clusserath ..... B67C 3/10 141/44
7,243,483 B2 * 7/2007 Clusserath ..... B67C 3/281 141/290
7,647,950 B2 * 1/2010 Clusserath ..... B67C 3/12 141/44
8,695,647 B2 * 4/2014 Ruble ..... B67C 3/10 141/144
2001/0045242 A1 * 11/2001 Clusserath ..... B67C 3/286 141/144
2002/0179177 A1 * 12/2002 Tsukano ..... B67C 3/10 141/57
2004/0118479 A1 * 6/2004 Tsukano ..... B67C 3/281 141/57
2005/0199314 A1 * 9/2005 Ruble ..... B65B 39/004 141/146
2011/0197996 A1 * 8/2011 Clusserath ..... B67C 3/001 141/311 R
2014/0360624 A1 * 12/2014 Clusserath ..... B67C 3/001 141/91
2015/0013833 A1 * 1/2015 Clusserath ..... B67C 3/06 141/5
2016/0009533 A1 * 1/2016 Clusserath ..... B67C 3/002 141/91
2016/0016774 A1 * 1/2016 Clusserath ..... B67C 3/10 141/7
2016/0025267 A1 * 1/2016 Clusserath ..... B67C 3/10 141/4
2016/0052765 A1 * 2/2016 Clusserath ..... B67C 3/007 141/6

FOREIGN PATENT DOCUMENTS

FR 994101 A 11/1951
FR 2552749 A1 4/1985
GB 1515804 A 6/1978

* cited by examiner

FILLING DEVICES FOR ISOBARIC FILLING MACHINES FOR FILLING BOTTLES WITH ALIMENTARY LIQUIDS

CROSS-REFERENCE TO RELATED APPLICATIONS

This application is a National Phase Application of PCT International Application No. PCT/IB2013/059118, International Filing Date, Oct. 4, 2013, claiming priority to Italian Patent Application No. TO2012A000869, filed Oct. 5, 2012, and Italian Patent Application No. TO2013A000302, filed Apr. 15, 2013, all of which are hereby incorporated by reference in their entirety.

FIELD OF THE INVENTION

The present invention relates in general to isobaric filling machines for filling bottles with alimentary liquids, such as wine and beer, and more particularly to filling devices intended to be installed on such machines, as described and claimed herein.

A filling device of the type described above is known for example from EP-A-2 236 454.

BACKGROUND OF THE INVENTION

The filling of bottles is generally classified in two categories, i.e. level filling and volumetric filling, depending on the technology used to detect when the right amount of liquid supplied has been reached. In turn, level filling differs depending on the liquid to be processed. In the case of non-gaseous liquids filling is performed at atmospheric pressure or under a slight vacuum, in the case of gaseous liquids an isobaric filling is performed and in the case of viscous liquids filling is performed under conditions where there is a pressure difference, obtained by creation of high vacuum or by overpressure.

The filling device according to the present invention falls within the category of level-filling devices, and more precisely devices of the type performing isobaric level filling (hereinafter simply referred to as "isobaric filling").

FIG. 1 of the accompanying drawings shows an axially sectioned view of a known example of a filling device for an isobaric filling machine. The filling device is denoted overall by 10 and comprises essentially:

- a body 12 intended to be fixed to a bottom wall 14 of a tank 16 of a filling machine, the body 12 having an inner cavity 18 which is open at the top and communicates at the bottom with the outside by means of a nozzle 20 with a conical cross-section which is fixed to the body 12 and the axis z of which is oriented vertically;
- a first tube, or outer tube, 24 which is fixed to the top part of the body 12 and is arranged coaxially with the nozzle 20, passing, in the assembled condition of the filling device on the filling machine, through a hole 22 in the bottom wall 14 of the tank 16 and extending up to a certain distance from the bottom of the tank;
- a second tube, or inner tube, 26 which is arranged coaxially with the nozzle 20 and the outer tube 24, extending inside the outer tube 24 and emerging at the bottom from the body 12 through the nozzle 20;
- a centring cone 28 which is arranged coaxially with the nozzle 20 and the inner tube 26 and is provided with a seal member 30 for sealing against the top end of the neck of a bottle (not shown) to be filled; and

- a valve assembly 32 comprising a plurality of valves 34 (in the example shown three valves) intended to be controlled by means of cams suitably configured to start and stop the various steps provided for by the bottle filling cycle.

The filling device 10 also comprises a closure member 36 (referred to below as first closure member) which is provided with a seal member 38 and is fixed to the inner tube 26, coaxially therewith, so as to cooperate with a conical surface portion 40 of the inner cavity 18 of the body 12. The inner tube 26, and together therewith the first closure member 36, is movable with respect to the assembly formed by the body 12 and by the outer tube 24 between a lowered position (shown in FIG. 1), in which the first closure member 36, by means of the seal member 38, closes off the passage from the inner cavity 18 to the nozzle 20, and a raised position (not shown), in which an annular passage is created between the first closure member 36 and the conical surface portion 40 of the inner cavity 18, through which passage the liquid which flows from the tank 16, through one or more openings 42 provided in the outer tube 24, to the annular conduit 44 defined between the outer tube 24 and the inner tube 26 may flow out towards the nozzle 20 and from here into the bottle. The first closure member 36 is pushed towards the raised position by a spring 46 arranged between a snap ring 48 mounted on the outer tube 24 and an abutment member 50 fixed to the top end of the inner tube 26.

The filling device 10 also comprises a second closure member 66 which is positioned coaxially with the inner tube 26, above the latter, and is movable axially with respect to the inner tube 26 between an open position (position shown in FIG. 1), in which it is at a distance from the top end of the inner tube 26 and therefore leaves this tube open, and a closed position (not shown), in which it makes sealing contact with the top end of the inner tube 26 and therefore keeps this tube closed.

In the case of gaseous liquids, and more particularly in the case of sparkling wine, the bottle filling cycle with a filling device such as that of the known type shown in FIG. 1 comprises typically the steps described below.

First of all, the bottle to be filled is raised by means of a pneumatic piston so as to be pressed against the seal member 30 of the centring cone 28 until the centring cone 30 comes into contact against the body 12 around the outlet section of the nozzle 20, so as to provide a perfect seal between the body and the bottle in order to contain the filling pressure.

This is followed by a deaeration step, during which the air contained inside the bottle is forced out of it by means of a liquid-ring vacuum pump (not shown).

Then the bottle is put in communication with the portion of the tank 16 situated above the level L of the liquid through the inner tube 26 (with the second closure member 66 in the open position) in order to carry out the pressure compensation step, during which the gas under pressure contained in the tank passes from the latter into the bottle until the gas contained in the tank and the gas contained in the bottle are at the same pressure.

Once a balance between the pressure of the gas in the tank 16 and the pressure of the gas in the bottle is reached, the spring 46 causes raising of the inner tube 26, and together therewith of the first closure member 36, thus allowing the liquid contained in the tank to fill the bottle passing through the annular passage defined between the nozzle 20 and the inner tube 26 (filling step). During filling of the bottle with the liquid, the gas previously introduced into the bottle returns into the top portion of the tank 16 flowing inside the inner tube 26. When the level of the liquid in the bottle has reached a given predefined value, the assembly formed by the inner tube 26 and by the first closure member 36 is moved into the lowered position so as to interrupt the flow of fluid from the tank into the bottle. The filling step is then followed by a levelling step during which gas under a slight overpressure (about 0.2 bar greater than the pressure present in the bottle) is introduced into the bottle through the annular passage defined between the nozzle 20 and the inner tube 26, with the first closure member 36 remaining in the lowered position, so that the excess liquid contained in the bottle, i.e. the liquid which is situated above the bottom end of the inner tube 26, is conveyed back into the tank 16 through this tube.

This is followed by a degassing step during which the inside of the bottle is put in communication with the outside so as to eliminate slowly the overpressure produced during the previous step.

Finally, the pneumatic piston is lowered so as to allow removal of the bottle which has now been filled.

The main drawback of the known filling devices for isobaric filling machines, such as that described above with reference to FIG. 1 or that known from the aforementioned prior document, consists in the poor precision in the bottle filling level. This is due in particular to the fact that, when the first closure member with the associated seal member closes off the flow of the liquid towards the bottle, the liquid which is already present between the nozzle and the inner tube downstream of this closure member enters into the bottle and therefore increases the filling level of the bottle with respect to that desired. The levelling step described above is therefore required, this resulting in a considerable amount of liquid flowing back into the tank and therefore in an increase in the danger of contamination of the liquid in the tank. Moreover, once the inner tube has been closed by means of the second closure member, any liquid contained inside this tube may return into the bottle and therefore modify the (correct) filling level reached.

A further drawback of the known isobaric filling devices is that adjustment of the filling level is obtained by displacing vertically the inner tube (gas return tube), which results in these devices being particularly complex.

Moreover, the known isobaric filling devices are all provided with a certain number of springs in order to ensure that the pressure levels are balanced and perform opening or closing of the closure members, this resulting in these devices being constructionally even more complicated and creating greater problems during washing and sterilization, in view of the large surface area of the springs exposed to contact with the liquid.

SUMMARY OF THE INVENTION

An object of the present invention is to provide a filling device for an isobaric filling machine for filling bottles with alimentary liquids which is not affected by the drawbacks of the prior art discussed above, in particular which is able to offer a high degree of precision as regards the filling level of the bottle, is constructionally and functionally simple and is easy to wash and sterilize.

This and other objects are fully achieved according to the present invention by means of filling devices as described and claimed herein.

Owing to the fact that the first closure member is arranged at the bottom end of the inner tube so as to cooperate with the bottom end of the outer tube, closure of the liquid flow occurs in the vicinity of the hole through which the inner tube communicates with the inside of the bottle, thus allowing a greater degree of precision of the filling level to be obtained, moreover without the need to carry out the levelling step described above.

Preferably, the second closure member is also arranged close to the bottom end of the inner tube so as to open/close this tube at the bottom, instead of at the top. Owing to this arrangement of the second closure member, a high degree of precision of the filling level is obtained without having to carry out a step for emptying the inner tube via which, in the known filling devices, the liquid present in the inner tube is conveyed back into the tank. In fact, as will result more clearly from the description below, once the inner tube has been closed at the bottom by means of the second closure member, any liquid contained inside the tube itself at the end of the filling step cannot return into the bottle and therefore cannot modify the (correct) filling level reached. The fact of being able to avoid carrying out the aforementioned emptying step means that an (albeit minimum) amount of liquid is not conveyed back into the tank and therefore the risk of contamination of the product inside the tank is further reduced.

According to an embodiment, the filling device comprises a pressure sensor for measuring the pressure reached inside the bottle, which allows opening and closing of the closure members to be controlled without having to provide special springs, resulting in the device being less complex from a constructional and functional point of view and easier to wash and sterilize.

According to an embodiment, the body of the filling device is movable vertically with respect to the tank of the filling machine, which allows adjustment of the filling level by simply varying the vertical position of the body since, by varying the vertical position of the body, the stop position of the centring cone is also varied.

Further features and advantages of the present invention will result more clearly from the following detailed description provided purely by way of non-limiting examples, with reference to the attached drawings.

DETAILED DESCRIPTION

Figure 1:
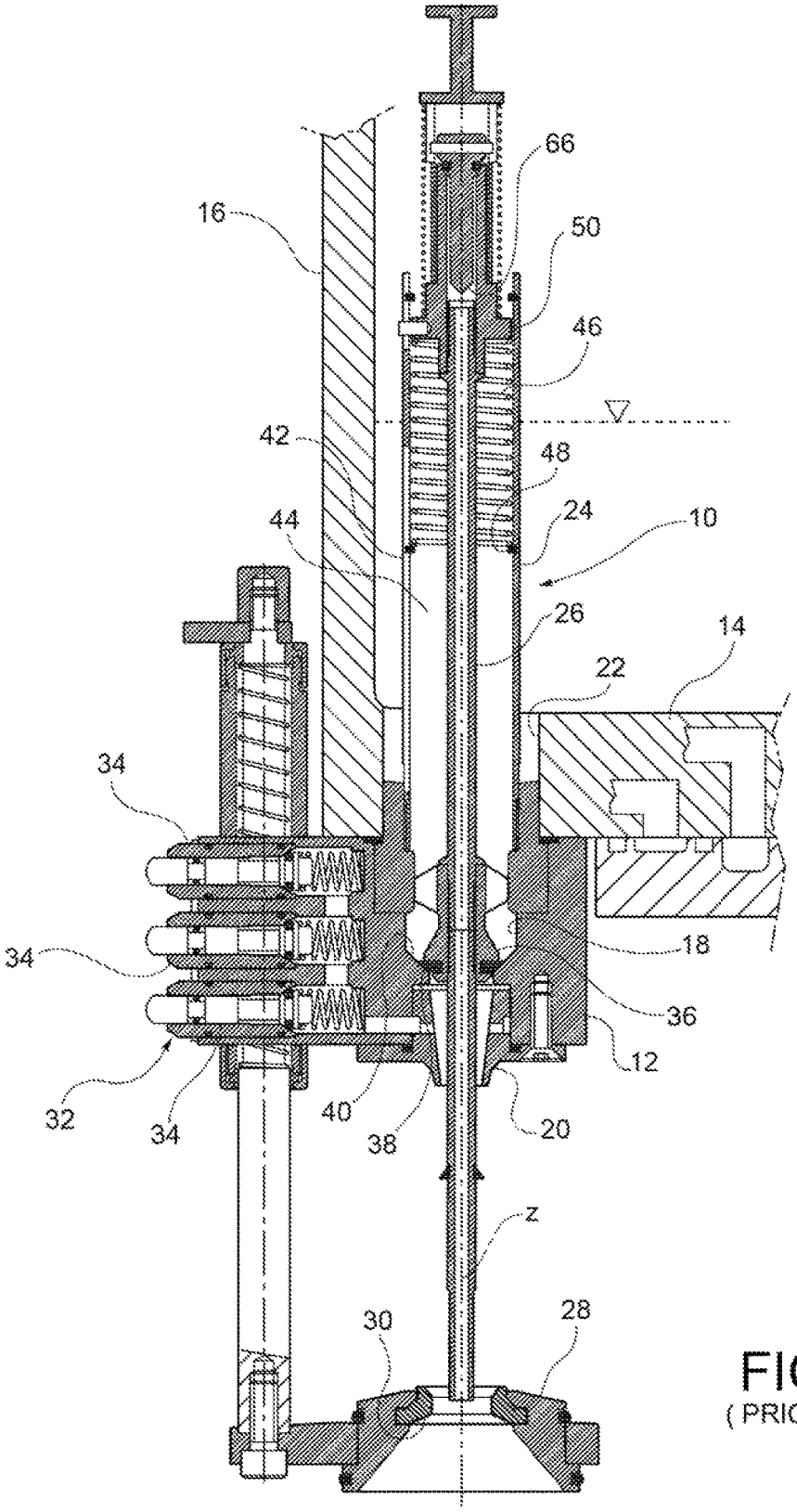
FIG. 1 ( PRIOR ART )
FIG. 1 is an axially sectioned view of a filling device for isobaric filling machines according to the prior art.
Figure 2:
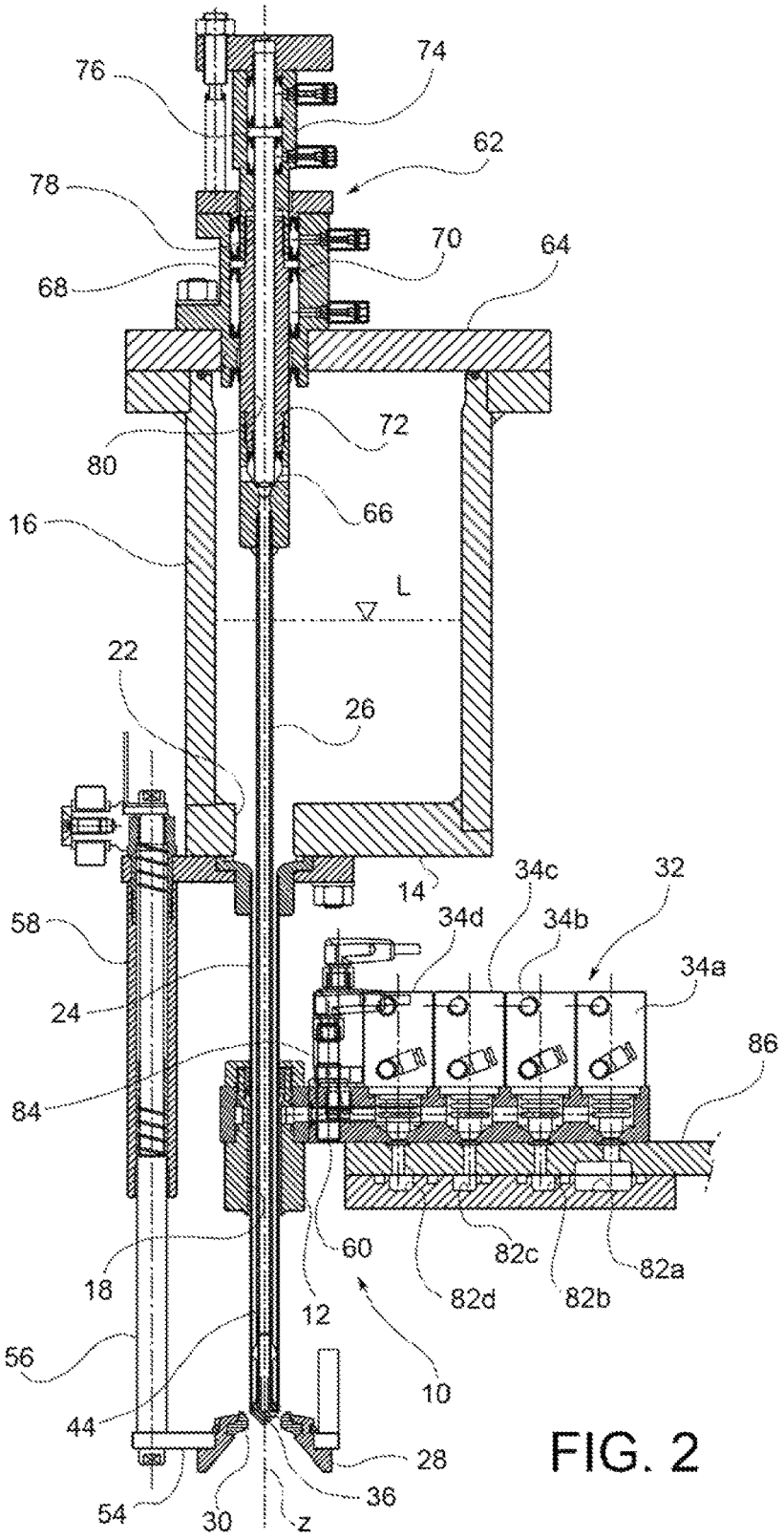
FIG. 2 is an axially sectioned view of a filling device for isobaric filling machines according to an embodiment of the present invention.
Figure 3:
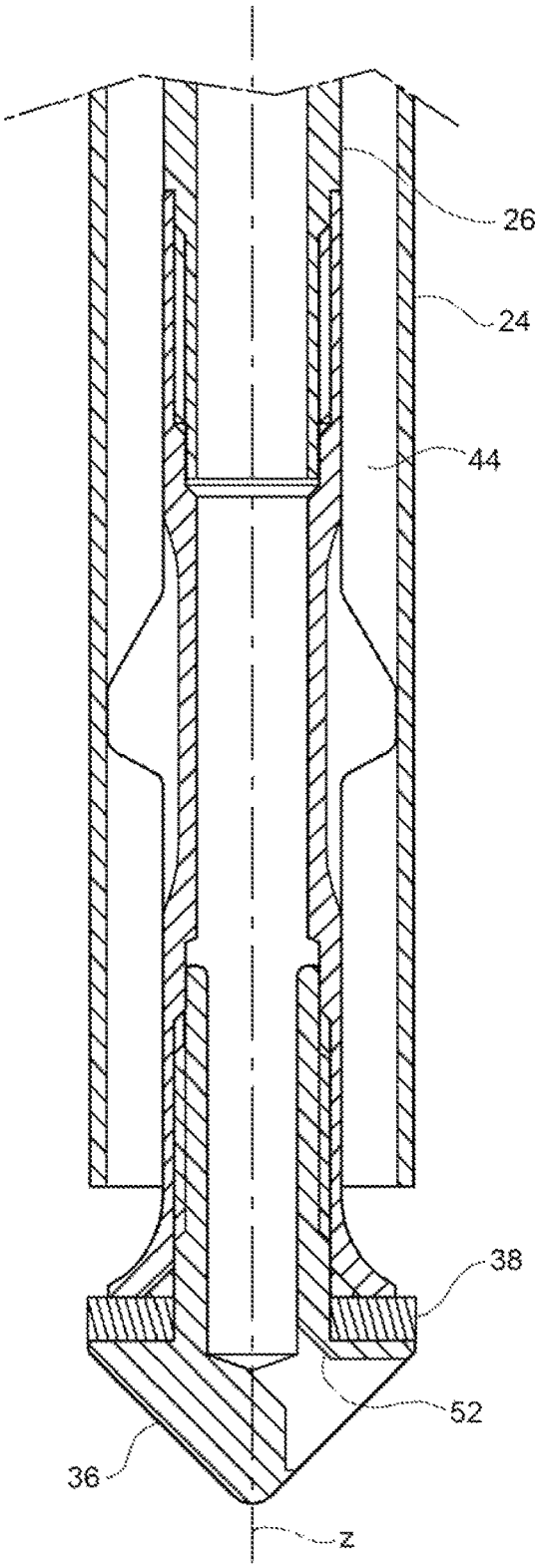
FIG. 3 shows, on an enlarged scale, the bottom portion of the filling device of FIG. 2.

With reference to FIGS. 2 and 3, in which parts and elements identical or corresponding to those of FIG. 1 (prior art) have been assigned the same reference numbers, a filling device for isobaric filling machines according to an embodiment of the present invention is denoted overall by 10 and comprises essentially:

- a body 12 having an inner cavity 18 of cylindrical shape which extends vertically through the entire body 12;
- an outer tube 24 with a vertical axis (denoted by z) which is fixed at the top to a bottom wall 14 of a tank 16 of the filling machine, extends through the inner cavity 18 of the body 12 and projects downwards relative to the body 12;

an inner tube 26 which is arranged coaxially with the outer tube 24 and extends partly (bottom part) inside the outer tube 24 and partly (top part) inside the tank 16, after passing through a hole 22 provided in a bottom wall 14 of the said tank, reaching with its top end a level above the level L of the liquid in the tank 16;

a centring cone 28 which is arranged coaxially with the two tubes, i.e. outer tube 24 and inner tube 26, and is provided with a seal member 30 for sealing against the top end of the neck of a bottle (not shown) to be filled; and a valve assembly 32 comprising a plurality of pneumatically operated valves, in particular four pneumatically operated valves 34*a*, 34*b*, 34*c* and 34*d*, configured to start and stop, according to predetermined operating modes, the various steps provided for by the bottle filling cycle.

An annular conduit 44 is therefore defined between the outer tube 24 and the inner tube 26, extending as far as the bottom end of the outer tube and allowing the liquid contained in the tank 16 to flow through it downwards to fill a bottle. The liquid flow along the annular conduit 44 is controlled by a first closure member 36 provided with a seal member 38. The first closure member 36 is fixed to the inner tube 26, coaxially therewith, at a bottom end portion thereof which projects downwards from the outer tube 24, in order to cooperate with the bottom end of the outer tube 24. The inner tube 26, along with the first closure member 36, is movable with respect to the outer tube 24 between a raised position (shown in FIG. 2), in which the first closure member 36, by means of the seal member 38, closes the annular conduit 44 at the bottom, preventing therefore the liquid contained in the tank 16 from flowing out from the filling device 10 and filling the bottle, and a lowered position (shown in FIG. 3), in which the first closure member 36 leaves the annular conduit 44 open at the bottom, thus allowing the liquid contained in the tank 16 to flow out from the filling device 10 and fill the bottle. Still with reference to FIG. 3, the first closure member 36 has, below the seal member 38, a hole 52 formed in particular as an oblique hole and having the function of connecting the inner tube 26 to the outside, in particular for the passage of gas from the tank to the bottle and vice versa, as will be explained more clearly below.

The centring cone 28 is mounted on a support plate 54 which is fixed to the bottom end of a pair of rods 56 (only one of which is visible in the cross-sectional view of FIG. 2) arranged with their axis parallel to and at a distance from the axis z of the said centring cone and of the outer tube 24 and inner tube 26. Each rod 56 is guided slidably in a respective cylinder 58 fixed to the tank 16, in particular to the bottom wall 14 of the latter, so as to allow the centring cone 28 to move vertically relative to the tank 16 as well as relative to the outer tube 24. In particular, the travel of the vertical movement of the centring cone 28 is such as to allow the latter to come in contact against the bottom side of the body 12, this being a necessary condition for the device to be able to perform filling of a bottle in isobaric mode.

According to an embodiment, the body 12 has, mounted thereon, a proximity sensor 60 for detecting the presence of the bottle underneath the filling device 10 in order to start the filling method and/or a pressure sensor 84 for measuring the pressure reached inside the bottle.

The filling device 10 also comprises an actuation unit 62 which is associated with the top end of the inner tube 26 to control the vertical movement of the latter, as well as that of the first closure member 36 with the associated seal member 38, between the lowered position and raised position defined above and to control the flow of gas through this tube. The actuation unit 62 is mounted on a cover 64 of the tank 16 and comprises a first linear actuator and a second linear actuator which are mounted in series with each other, wherein the first linear actuator is able to control the vertical movement of the inner tube 26 and the second linear actuator is able to control the vertical movement of a second closure member 66 to open or close the inner tube 26, in this case the top end of this tube. The first linear actuator is preferably formed as a double-acting pneumatic cylinder and comprises a cylinder 68 fixed to the cover 64 of the tank 16 coaxially with the inner tube 26 and a piston 70 mounted slidably in the cylinder 68. The piston 70 has a stem 72 which projects downwards from the cylinder 68 and is fixed to the top end of the inner tube 26 so as to be integral therewith during its vertical translation movement. The second linear actuator is also preferably formed as a double-acting pneumatic cylinder and comprises a cylinder 74, which is connected to the piston 70 of the first linear actuator so as to be integral with the latter during its vertical translation movement, and a piston 76 mounted slidably in the cylinder 74. The piston 76 has a stem 78 which projects downwards from the cylinder 74 and extends through a coaxial cylindrical cavity 80 formed in the stem 72 of the piston 70 of the first linear actuator. The second closure member 66 is fixed to the bottom end of the stem 78 and is therefore integral with the stem 78 during its vertical translation movement.

According to an embodiment, the body 12 is vertically movable so as to allow the stop position of the centring cone 28 to be varied. Preferably, the bodies 12 of all the filling devices 10 with which the machine is provided are mounted on a same support flange 86 able to be moved vertically.

Preferably, the valve assembly 32 of each filling device 10 is directly or indirectly fixed to the body 12 of the respective device so as to move vertically together with the latter. In the case where the aforementioned support flange 86 is present, the valve assemblies 32 of all the filling devices 10 of the machine will be preferably mounted on this flange as well.

Operation of the filling device 10 in the case of filling of a bottle with a sparkling wine will now be described.

First of all the bottle to be filled is raised by means of a pneumatic piston (not shown) to be pressed against the seal member 30 of the centring cone 28 until the centring cone 30 comes into contact against the bottom side of the body 12, so as to provide a perfect seal between body and bottle for containing the filling pressure. The proximity sensor 60 detects the presence of the bottle underneath the filling device 10 and starts the filling process.

The pneumatically operated valve 34*a* is then activated to connect the inside of the bottle with a vacuum circuit 82*a* and thus start a deaeration step during which the air contained inside the bottle is expelled therefrom. Once the deaeration step has been completed, the pneumatically operated valve 34*a* is activated to close the vacuum circuit 82*a*.

This is followed by a pressure compensation step during which the gas present in the tank 16 and the gas present in the bottle are set to the same pressure. For this purpose, the pneumatically operated valve 34*b* is activated to connect the inside of the bottle with the top part of the tank 16, i.e. the part situated above the level L of the liquid, by means of a circuit 82*b*. During the pressure compensation step, the pressure sensor 84 measures the pressure reached inside the bottle. In the event of bottle breaking or bursting, the pressure sensor 84 indicates that the compensation pressure has not been reached and the machine interrupts the filling cycle. Once the pressure compensation step has been completed, the pneumatically operated valve 34*b* is activated to close the circuit 82*b*.

An overpressure step is then carried out, during which a certain overpressure is created in the bottle. For this purpose, the pneumatically operated valve 34*c* is activated to open a circuit 82*c* through which the inside of the bottle is brought to a pressure which is slightly higher (for example, about 0.2 bar higher) than the pressure present in the tank. Then the pneumatically operated valve 34*c* is closed and the second closure member 66 is raised by means of the second pneumatic cylinder (cylinder 74 and piston 76) so as to connect the inner tube 26 to the part of the tank 16 above the level L of the liquid contained therein. Owing to the effect of the overpressure present inside the bottle, any liquid droplets remaining on the inner wall of the inner tube 26 are propelled inside the tank 16. In this way, these droplets are prevented from falling into the bottle and therefore giving rise to the possible formation of foam. The overpressure step may be omitted should foam formation conditions not exist.

At this point a filling step is performed, during which the liquid contained in the tank 16 is introduced into the bottle up to a predetermined level. For this purpose the first pneumatic cylinder (cylinder 68 and piston 70) is operated so as to cause the displacement of the assembly formed by the inner tube 26 and by the first closure member 36 into the lowered position and therefore allow the liquid to fall by gravity from the tank 16 into the bottle via the annular conduit 44. During the filling step, as the liquid gradually fills the bottle, the gas already present in the bottle returns into the tank 16 via the hole 52 and the inner tube 26. The filling step terminates when the liquid in the bottle reaches a level such as to obstruct the hole 52 provided in the first closure member 36. It will be noted in this connection that in the filling device 10 according to the invention the final level of the liquid in the bottle is defined by the sinking of the first closure member 36 inside the bottle. In order to vary the filling level, it is therefore sufficient to vary the position of the body 12. This position defines in fact the stop position of the centring cone 28 when the bottle is pushed upwards against said centring cone at the start of the filling cycle, and therefore a variation in this position results in a corresponding variation in the relative position of the first closure member 36 with respect to the bottle. Since the body 12 is preferably mounted on the support flange 86, which is common to all the filling devices of the machine, the adjustment of the filling level is carried out simultaneously for all the filling devices present on the machine. Moreover, the adjustment of the filling level may be carried out while the machine is in operation.

Once the predefined filling level has been reached, the first pneumatic cylinder 68, 70 is operated to cause the displacement of the assembly formed by the inner tube 26 and the first closure member 36 into the raised position, so as to close the annular conduit 44 at the bottom. At this point an emptying step is performed, during which the liquid present in the inner tube 26 is conveyed back into the tank 16. For this purpose, the pneumatically operated valve 34*c* is opened and by means of the circuit 82*c* creates a pressure inside the bottle slighter higher than the pressure present in the tank (about 0.2 bar higher) so as to propel the liquid present in the inner tube 26 into the tank 16. Once the emptying step has been completed, the second pneumatic cylinder 74, 76 is operated to cause lowering of the second closure member 66 and therefore the closure of the inner tube 26 also at its top end.

Finally, a degassing step is carried out, during which the pneumatically operated valve 34*d* is opened and closed in succession, thus putting alternately the inside of the bottle in communication with a circuit 82*d* which is at atmospheric pressure in order to eliminate gradually the pressure present in the bottle and therefore limit the formation of foam.

The advantages achieved by a filling device according to the embodiment described above with reference to FIGS. 2 and 3 are evident.

First of all, owing to the fact that the first closure member with a seal member which opens/closes the flow passage area for the liquid from the tank to the bottle is provided at the bottom end of the inner tube and cooperates with the bottom end of the outer tube, closure of the liquid flow passage occurs in the vicinity of the hole via which the inner tube communicates with the inside of the bottle, thus making it possible to obtain a greater precision of the filling level and therefore avoid having to carry out the filling step, which is instead necessary in the case of the known filling devices, such as that according to FIG. 1, and which involves the risk of contamination of the liquid contained in the tank by the liquid which is conveyed back from the filling device into the tank.

Moreover, owing to the presence, on the body of each filling device, of a pressure sensor for measuring the pressure reached inside the bottle, it is possible to control opening and closing of the closure members without the need for springs, resulting in a device which is less complex from a constructional and functional point of view and easier to wash and sterilize.

Moreover, owing to the fact that the body of the filling device is movable vertically with respect to the tank of the filling machine—and the filling level may therefore be adjusted by simply varying the vertical position of the body, instead of varying the vertical position of the inner tube of the filling device—the device is much simpler from a constructional and functional point of view.

Moreover, whereas in the known filling devices, the respective duration of the deaeration, levelling and degassing steps is determined by the profiles of the cams which operate the valves and, therefore, once these profiles have been defined, they are fixed, with the filling device according to the present invention, owing to the fact that the valves are pneumatically operated valves, it is instead possible to vary the duration of each step by modifying the control program which controls opening and closing of these valves.

Moreover, whereas in the known filling machines, the valves associated with each filling device are situated partly in the vicinity of the body of the filling device and partly above the tank, which results in obvious size problems, in the filling device according to the present invention all the valves of the valve assembly, together with the associated conduits, are mounted on the support flange on which the body of the filling device is also mounted, and are therefore situated in the vicinity of the neck of the bottle during the filling cycle, thus allowing a reduction in the volumes of the conduits involved during the various steps of the filling cycle.

Figure 4:
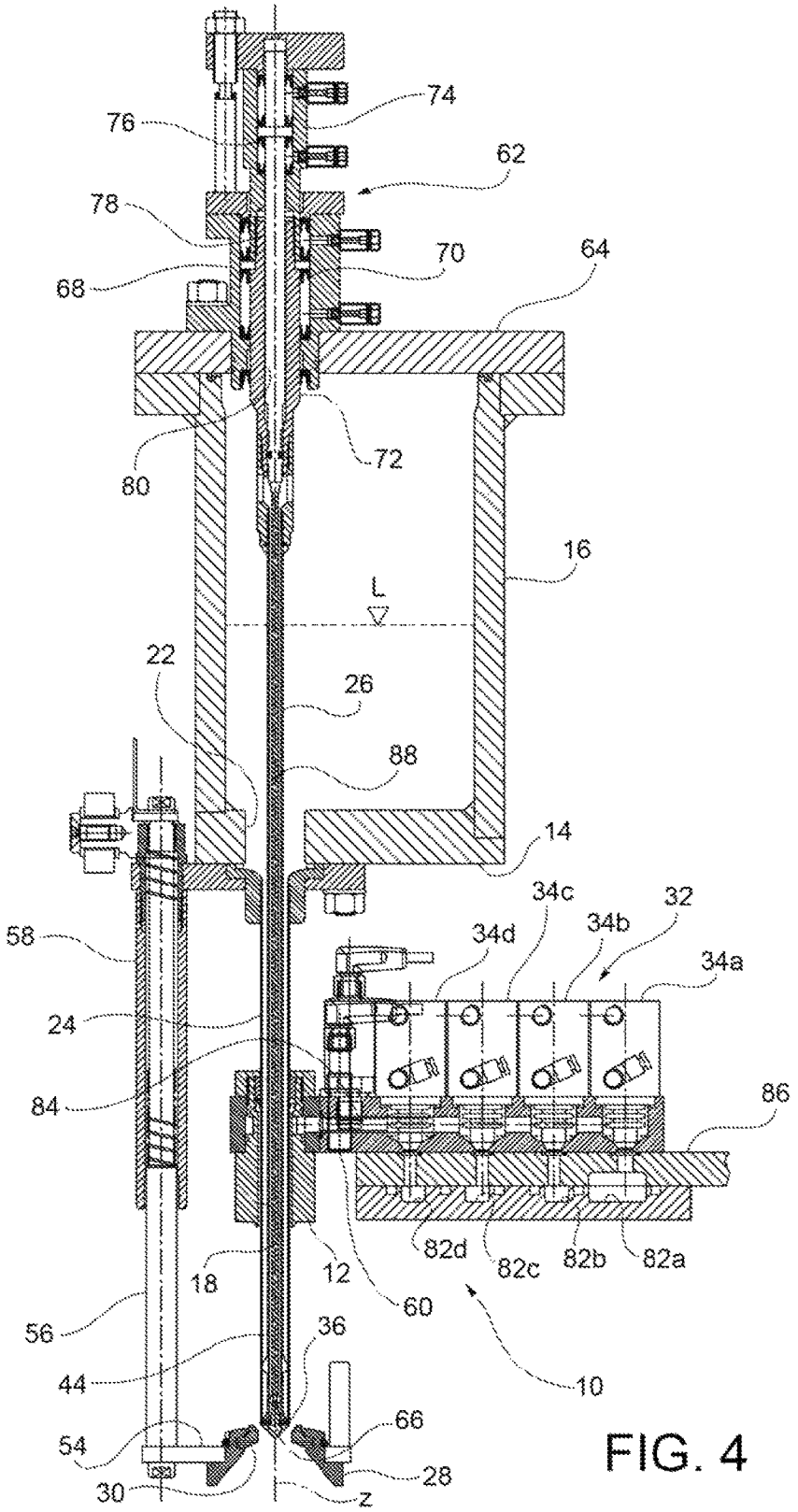
FIG. 4 is an axially sectioned view of a filling device for isobaric filling machines according to a further embodiment of the present invention.
Figure 5:
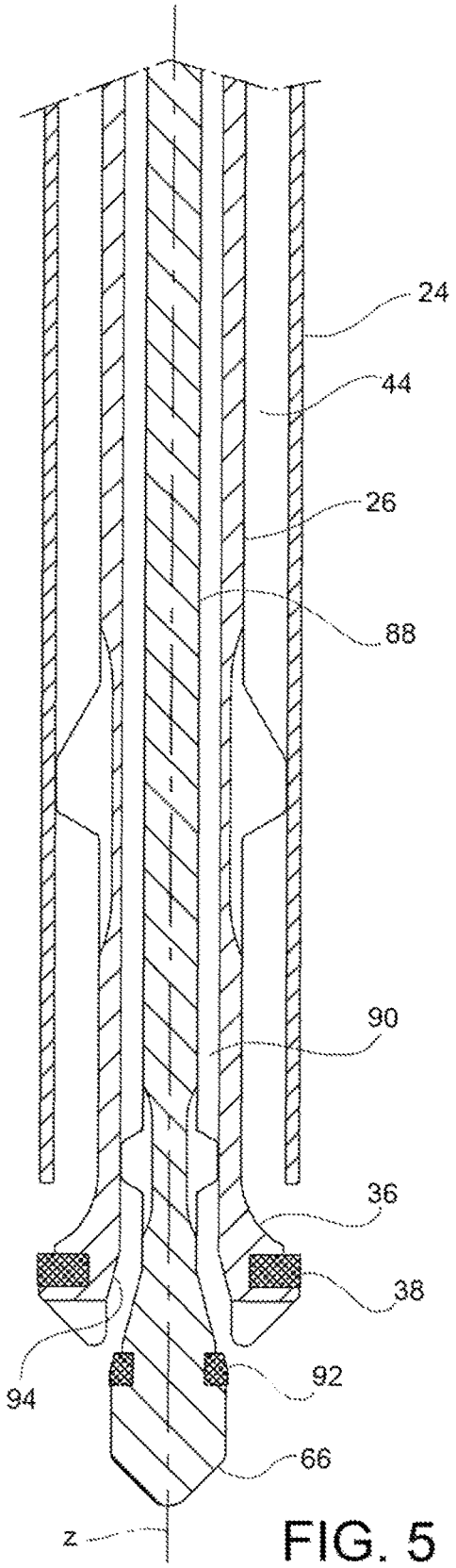
FIG. 5 shows, on an enlarged scale, the bottom portion of the filling device of FIG. 4.

A filling device for filling machines according to a further embodiment of the present invention is shown in FIGS. 4 and 5. The filling device according to this further embodiment has a structure and operation basically similar to those of the filling device according to the embodiment described above with reference to FIGS. 2 and 3. For the sake of brevity, therefore, only the features of the filling device according to FIGS. 4 and 5 which are different from those of the filling device according to FIGS. 2 and 3 will be described, the description provided above of the filling device according to FIGS. 2 and 3 being applicable as regards the remaining features.

With reference therefore to FIGS. 4 and 5, in which parts and elements which are identical or correspond to those shown in FIGS. 2 and 3 have been assigned the same reference numbers, according to this further embodiment of the present invention, the second closure member 66 of the filling device 10 is arranged in the vicinity of the bottom end of the inner tube 26, instead of in the vicinity of the top end thereof. For this purpose, the stem 78 of the piston 76 is provided with an extension formed by a rod 88 provided at its bottom end with the second closure member 66. The rod 88 extends inside the inner tube 26, coaxially therewith, and has an outer diameter which is smaller than the inner diameter of this tube, so that an annular conduit 90 is defined between the rod 88 and the inner tube 26 (FIG. 5). The rod 88, which is fixed to the stem 78 of the piston 76, is therefore able to slide freely inside the inner tube 26 and in this way operate the second closure member 66, which is provided with a seal member 92 configured to perform fluid-tight sealing of the annular conduit 90, so as to control opening/closing of the annular conduit 90 and therefore of the inner tube 26.

According to the embodiment of FIGS. 4 and 5, in which both the first closure member 36 and the second closure member 66 are arranged in the vicinity of the bottom end of the inner tube 26, the first closure member 36 has a conical seat 94 with which the seal member 92 provided on the second closure member 66 is configured to cooperate.

As already mentioned above, owing to this arrangement of the second closure member in the vicinity of the bottom end of the inner tube, the filling device is able to ensure a high degree of precision of the filling level without the need to carry out a step for emptying the inner tube via which, in the known filling devices, the liquid present in the inner tube is conveyed back into the tank.

Moreover, with such a filling device it is possible to carry out more efficiently compared to the prior art, the degassing step (i.e. that step of the filling cycle in which the inside of the bottle is put in communication alternately with the atmospheric pressure in order to eliminate gradually the pressure present inside the bottle and therefore limit the formation foam) on difficult products such as sparkling wine, beer, etc., owing to the fact that the arrangement of the second closure member at the bottom end of the inner tube allows the volume of gas contained in the inner tube to be excluded from the degassing step, with the result that the volume of gas to be degassed is about half that of the conventional filling devices in which the second closure member is situated at the top end of the inner tube.

Naturally, the principle of the invention remaining unchanged, the embodiments and the constructional details may be greatly modified with respect to those described and illustrated purely by way of a non-limiting example, without thereby departing from the scope of the invention as described and claimed herein.

The invention claimed is:

1. A filling device for isobaric filling machines for filling bottles with alimentary liquids, the filling device comprising:

a body having an inner cavity which extends vertically through said body;

an outer tube configured to be fixed at the top to a bottom wall of a tank extending through the inner cavity of the body and projecting downward relative to the body;

an inner tube arranged coaxially with the outer tube, extending with a lower portion thereof inside the outer tube and projecting upward relative to the outer tube, so as to reach with its top end, in the assembled condition of the filling device on the machine, a level higher than the level (L) of the liquid contained in the tank, the outer tube and the inner tube defining a first annular conduit extending as far as the bottom end of the outer tube and through which the liquid contained in the tank can flow downward to fill a bottle;

a centering cone arranged coaxially with the outer tube and the inner tube configured for sealing against the top end of a neck of a bottle to be filled;

a first closure member arranged so as to be vertically movable relative to the outer tube and configured to seal the first annular conduit;

a second closure member arranged so as to be vertically movable relative to the inner tube and configured to seal the inner tube; and an actuation unit designed to control the vertical movement of the first closure member and the second closure member;

wherein the first closure member is arranged close to the bottom end of the inner tube to cooperate with the bottom end of the outer tube so as to open or close the first annular conduit at the bottom, wherein the first closure member is fixed to the bottom end of the inner tube and wherein the assembly formed by the inner tube and by the first closure member is vertically movable relative to the outer tube between a first position, in which the first closure member opens the first annular conduit at the bottom so as to allow the liquid contained in the tank to flow downward and fill the bottle, and a second position, in which the first closure member closes the first annular conduit at the bottom, thus preventing the liquid from flowing out of the first annular conduit.

2. The device of claim 1, wherein the actuation unit is operatively associated with the top end of the inner tube for controlling the vertical movement of the inner tube, as well as that of the first closure member, between the first position and the second position and for controlling the flow of gas through the inner tube.

3. The device of claim 1, wherein the first position of the assembly formed by the inner tube and by the first closure member is at a lower height than the second position and wherein the first closure member is provided with a seal member configured to seal the first annular conduit and comprises, below the seal member, a hole through which the inner tube is in communication with the outside.

4. The device of claim 1, wherein the second closure member is arranged close to the bottom end of the inner tube so as to open or close the inner tube at the bottom.

5. The device of claim 4, wherein the second closure member is provided at the bottom end of a sliding rod which extends within the inner tube, coaxially therewith, and provides with the inner tube a second annular conduit and wherein the actuation unit is designed to control the vertical movement of the sliding rod along with that of the second closure member.

6. The device of claim 1, wherein the actuation unit comprises a first linear actuator for controlling the vertical movement of the first closure member and a second linear actuator for controlling the vertical movement of the second closure member, the first linear actuator and the second linear actuator being mounted in series with each other.

7. An isobaric filling machine for filling bottles with alimentary liquids, comprising a tank for containing the alimentary liquid and a plurality of filling devices according to claim 1.

8. The isobaric machine of claim 7, wherein the body of each filling device is movable vertically with respect to the tank.

9. The isobaric machine of claim 7, further comprising a vertically movable support flange on which the body of each filling device is mounted.

10. The isobaric machine of claim 7, wherein each filling device further comprises a valve assembly comprising a plurality of pneumatically operated valves configured to start and stop deaeration, pressure compensation, overpressure and degassing steps provided for by the bottle filling cycle.

11. The isobaric machine of claim 10, wherein the valve assembly of each filling device is vertically movable with respect to the tank integrally with the body of the respective filling device.

12. The isobaric machine of claim 10, wherein both the body and the valve assembly of each filling device are mounted on the support flange.

* * * * *